US006155875A

United States Patent [19]

Ineson

[11] Patent Number: 6,155,875

[45] Date of Patent: Dec. 5, 2000

[54] MULTI-ANGLE ELECTRICAL CONNECTOR

[75] Inventor: David J. Ineson, Oakville, Conn.

[73] Assignee: Mannesmann VDO AG, Frankfurt am Main, Germany

[21] Appl. No.: 09/303,185

[22] Filed: Apr. 30, 1999

[51] Int. Cl.[7] ..... H01B 1/01

[52] U.S. Cl. ..... 439/564; 439/954

[58] Field of Search ..... 439/564, 573, 439/582, 565, 569, 954; 174/86; 285/363; 173/328, 339; 248/909, 906, 672; 200/293, 295, 300

[56] References Cited

U.S. PATENT DOCUMENTS 2,543,577 2/1951 Hugenholtz et al. .
2,572,813 10/1951 Murphy .
3,711,815 1/1973 Pierce et al. .
3,732,527 5/1973 McKnight .
5,000,701 3/1991 Norden ..... 439/680
5,007,862 4/1991 Defibaugh et al. .
5,827,078 10/1998 Simonian .
5,882,226 3/1999 Bell et al. .

*Primary Examiner*—Neil Abrams
*Assistant Examiner*—Chandrika Prasad
*Attorney, Agent, or Firm*—Mayer, Brown & Platt

[57] ABSTRACT

An electrical connector having a housing, a plurality of conductive terminals supported within the housing, and a flange extending outward from the housing. The flange has a plurality of selectively removable portions to permit the connector upon removal of one of the portions to be adapted for use in a particular angular mounting position.

20 Claims, 3 Drawing Sheets

MULTI-ANGLE ELECTRICAL CONNECTOR

BACKGROUND OF THE INVENTION

1. Field of the Invention

The present invention generally relates to electrical connectors for electrical devices, such as motors or sensors. More particularly, the invention relates to multi-angle electrical connectors that include a flange having a plurality of removable portions that facilitate removal of at least one portion to adapt the connector to be mounted at a predetermined angle.

2. Discussion of the Prior Art

Electrical devices of many types may be used in environments that require particular wiring routings to avoid physical interference with other components or environmental hazards such as unwanted electrical interference or contact with hot surfaces. For example, this is readily apparent in the varying underhood wiring layouts required in different motor vehicles having different engines or underhood systems configurations. Continuing with the example of use in a motor vehicle, some devices, such as the motor of a specific idle air control valve might find use in a variety of different vehicles. However, the different wiring routings required in different types of vehicles may require different electrical connector mounting angles to allow proper installation, operation and removal of the device and the wiring plug which mates with the electrical connector on the device. For instance, the wiring plug for a vehicle of a first type may need to approach the connector for the device horizontally, while in a vehicle of a second type it may need to approach the connector vertically or at some angle therebetween. These two different vehicle applications may be able to use the same motor or other device, but may require different electrical connectors to provide the respective different mounting angles to accomodate the necessary wiring routings. The need for different molds and manufacturing equipment to produce connectors having each of the single but different desired mounting angles adds cost to what would otherwise be common componentry.

Rather than equip different vehicles with different component connectors configured to accept a wiring plug approaching from only one angle, it is desireable to have a single connector that can be readily adapted to provide one of a plurality of different mounting angles. Indeed, there are prior art electrical connectors that are adjustable between multiple angular positions. However, such connectors that have adjustable mounting angles tend to be complex and expensive to produce. Also, due to the nature of manufacturing and assembly processes, it is undesirable to permit a connector to have more than one mounting position available. Therefore, to avoid the possibility of improper connector installation and wiring routing, it is preferred to limit a connector to a single mounting angle. Moreover, for sealing and component integrity purposes, it is undesirable to have the connector housing consist of multiple housing sections which hinge or rotate relative to each other to obtain different connector mounting angles. In light of the shortcomings and undesirable features commonly found in prior art electrical connector constructions, there exists a need for electrical connectors of simple construction that are capable of being adapted for use at one of a plurality of potential connector mounting angles. It is desirable that a connector have a plurality of removable portions to permit selective removal of one or more portions to adapt the connector to a single mounting angle. It further is desirable to have the connector include a light-weight, molded dielectric housing.

It further is advantageous to have the connector be adapted to be held at a single mounting angle and be secured to a product assembly by means of a single fastener.

The present invention overcomes disadvantages of prior connectors, while providing the above-mentioned desirable features.

SUMMARY OF THE INVENTION

The purpose and advantages of the invention will be set forth in and apparent from the description and drawings that follow, as well as will be learned by practice of the invention disclosed and claimed herein.

The present invention is generally embodied in an electrical connector. In accordance with one aspect of the invention, the connector comprises a housing, a plurality of conductive terminals supported within the housing, and a flange extending outward from the housing, the flange having a plurality of selectively removable portions whereby removal of at least one of the portions adapts the connector for use in a particular angular mounting position.

In a further aspect of the invention, the connector comprises a housing and at least one conductive terminal supported within the housing, the housing having a flange, the flange having a plurality of removable portions.

In accordance with another aspect of the invention, the connector comprises a housing having and a mounting flange, the flange having a plurality of removable portions whereby one of the portions may be removed to form a void in the flange to adapt the connector for mounting at a particular angle, the connector further comprising a plurality of electrically conductive terminals.

In another aspect of the invention, the conductive terminals may be over-molded into the connector housing.

In a further aspect of the invention, the flange and housing may be monolithically molded of a dielectrical material.

In a still further aspect of the invention, the removable portions of the flange of the electrical connector may be defined in part by apertures in the flange.

In another aspect of the invention, the removable portions of the flange of the electrical connector may be defined by areas of the flange having a reduced thickness.

In a still further aspect of the invention, the flange of the connector may extend outward from less than the entire perimeter of the housing.

In yet another aspect of the invention, the electrical connector may further comprise a fastener for engagement with the flange through a void created by removal of a removable portion of the flange.

One skilled in the art will appreciate that this invention could be utilized in many different electrical connector settings where a common device may require different particular mounting angles in different assembly situations.

BRIEF DESCRIPTION OF THE DRAWINGS

In describing the preferred embodiment, reference is made to the accompanying drawings wherein like parts have like reference numerals, and wherein.

It should be understood that the drawings are not to scale. It should also be understood that, as discussed below, the present invention is not limited to the embodiment illustrated.

DETAILED DESCRIPTION OF THE PREFERRED EMBODIMENT

Although one skilled in the art will appreciate that the invention has potential for very broad application with many electrical devices, an exemplary embodiment of a connector made in accordance with the invention is disclosed herein in conjunction with a motor of an idle air control valve for vehicle internal combustion engines. The idle air control valve, motor and engagement with a connector are described in detail in U.S. patent application Ser. No. 09/240,527.

Figure 1:
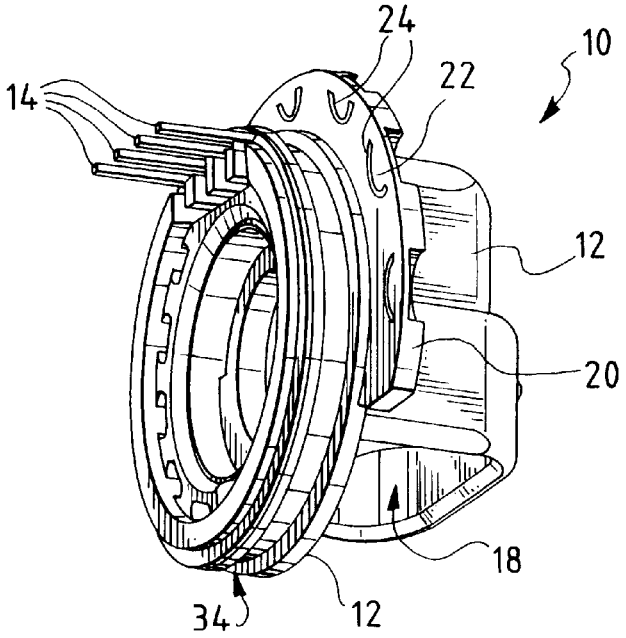
FIG. 1 is a front perspective view of an embodiment of an electrical connector in accordance with the invention prior to removal of any of the removable portions.
Figure 2:
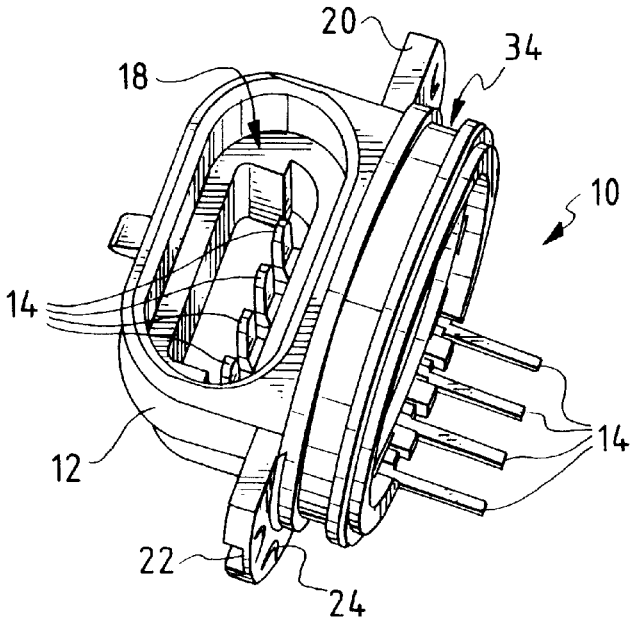
FIG. 2 is a bottom perspective view of the connector shown in FIG. 1.
Figure 3:
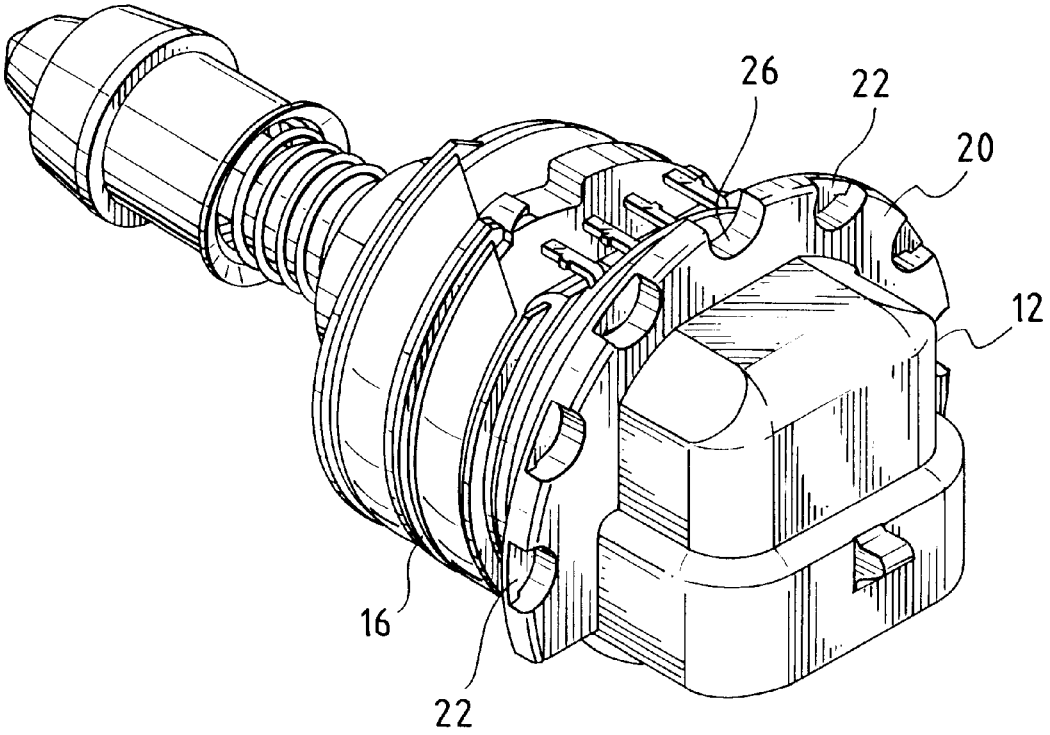
FIG. 3 is a rear perspective view of the connector of FIGS. 1 and 2 mated to the motor of an idle control valve and having the upper most removable portion removed.
Figure 4:
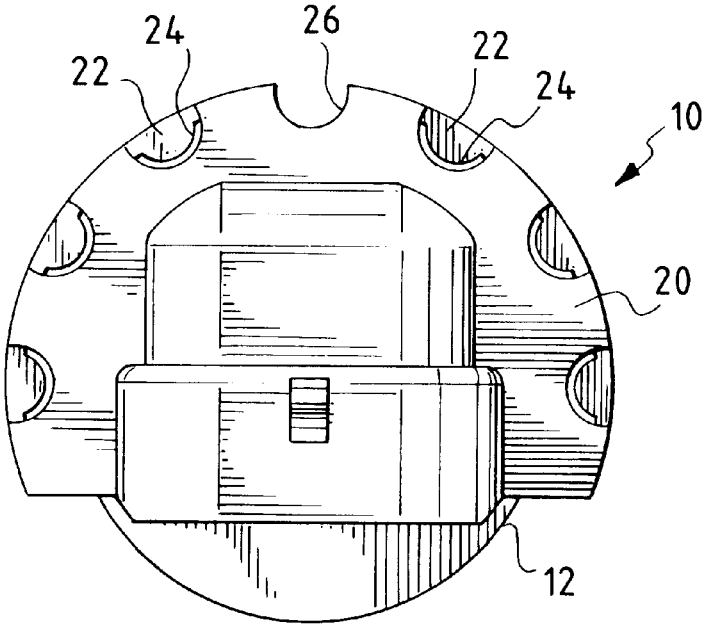
FIG. 4 is a rear view of the connector shown in FIG. 3.
Figure 5:
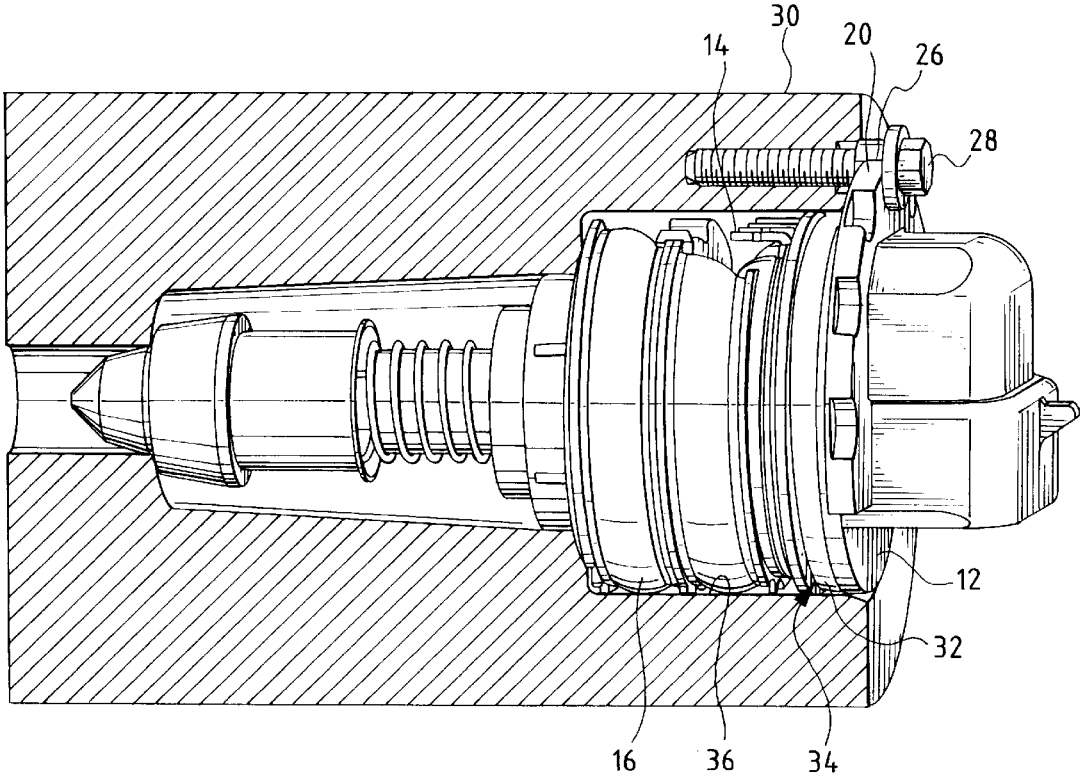
FIG. 5 is a side perspective view of the connector and motor of FIG. 3 mounted to a mating housing shown in a schematic cross-section.

Turning now to the drawings of the exemplary embodiment and referring to FIGS. 1–5, the connector 10 includes a housing 12. The housing 12 is preferrably constructed of monolithically injection molded dielectric material such as polybutylene terephthalate or other suitable material. As best seen in FIG. 2, supported within the connector is at least one conductive terminal 14. Terminals 14 are typically of metallic construction such as copper alloy or the like. Depending on the design criteria and preferred method of manufacturing, the terminals 14 may be over-molded in place in the housing 12 or may be inserted into preformed terminal cavities in housing 12. In this embodiment, the terminals 14 shown in FIG. 5 are connected conventionally to coil windings on the motor 16.

In this embodiment, the connector 10 is of the right-angle type. In essence, the housing has a socket 18 for receipt of a wiring plug (not shown) at an angle perpendicular to the connector's mating engagement with the electrical device, motor 16, shown in FIGS. 4 and 5. Thus, terminals 14 extend through the housing to achieve conductive engagement with the wiring plug at one end and with the motor at the other end. To accomplish this, the terminals 14 may have a bend somewhere along their length, or if the terminals are straight, the connector must be constructed to have the mating engagement at one of the ends approach from an angle relative to the surface along the length of the terminals.

The connector 10 further includes a flange 20 extending outward from at least a portion of the periphery of connector housing 12. In the embodiment shown, the flange 20 and housing 12 are dielectric material monolithically molded such that the flange 20 extends outward from the housing 12 in the area opposite the socket 18 where a wiring plug may mate with the connector 10. The flange 20 has removable portions 22 which may be defined by reduced material thickness and/or small voids or apertures 24. Having apertures 24 and/or regions of reduced material thickness facilitates easy removal portions or knock-outs 22 without further destruction or distortion of the flange 20. Apertures 24 or regions of reduced thickness may be molded into the flange 20 or alternatively machined into a continuous flange of uniform thickness. Also, while the flange 20 may be monolithically molded with the housing 12, it also may be constructed of a different material and joined to the housing. For instance, the flange may be metallic and over-molded to be integrally linked to the housing.

In the embodiment shown, the removable portions 22 provide potential notches angularly spaced apart from each other around the outer edge of peripheral flange 20 at desired intervals, such as approximately 30 degrees apart. Removal of one of the portions 22 forms a notch 26, best seen in FIGS. 3 and 4. As seen in FIG. 5, the notch 26 permits a mounting fastener 28 to pass through the void formed by removal of the portion 22 to provide for securement of the connector 10 to the mating assembly structure 30 while preventing rotation of the connector 10 relative to the mating assembly 30. The fastener 28 is shown schematically as a conventional bolt. however, connectors in accordance with the invention may be constructed to be combined with fasteners of virtually any desirable material and structure.

The flange 20 may be formed around the complete periphery of the housing 12 to provide removable portions throughout a 360 degree arc or, as shown in FIGS. 1–5, the flange 20 may project from less than the complete periphery. The preferred embodiment shows a low-profile connector 10 wherein the socket 18 is located close to the opposite end of the connector. One skilled in the art will appreciate that if the housing 12 is elongated to locate the socket 18 further from the flange 20, then fastener access could be had to additional potential voids in a flange that would continue around the housing 12.

In the embodiment shown, sealing engagement between the connector 10 and the mating assembly 30 is achieved by use of an O-ring seal 32, best seen in FIG. 5, which rests in a groove 34 in the connector housing, as seen in FIGS. 1 and 2. The O-ring seal 32 engages a bore 36 in mating assembly 30. Although the preferred embodiment shows an O-ring 32 in a groove 34 engaging a bore 36, the connector 10, the mating assembly 30 and the seal 32 therebetween may be of various shapes, configurations and constructions to provide sealing engagement between a surface of the connector and a surface of the mating assembly. Moreover, one of skill in the art will appreciate that, depending on the environment and anticipated use, the connector may not require a seal, or may have a seal of a different type between the connector and the mating assembly. Also, it will be appreciated that the connector could be configured to provide sealed engagement with the electrical device, such as the motor of the idle air control valve shown.

In accordance with the preferred embodiment, while a connector 10 having a plurality of spaced apart removable portions 22 offers a variety of potential mounting angles, removal of a single portion 22 permits installation only at one preselected angle and prevents improper installation at a different angle. Hence, all connectors requiring a particular connector mounting angle to achieve a particular wiring routing will have the same removable portion 22 removed, while connectors requiring a different mounting angle and resultant different wiring routing will have a different removable portion removed.

Although the preferred embodiment discloses use of a single fastener 28 and requires removal of only a single removable portion 22 for mounting, it will be appreciated that within the spirit of the invention, an engagement and fastening assembly could be made that requires removal of more than one removable portion. Such a structure may utilize more than one fastener or a combination of one or more fasteners and one or more projections or other structures to engage additional voids in the flange. Similarly, the assembly could be made to have at least one void in the flange engage a projection or other structure on the mating assembly 30 to locate the connector at the proper mounting angle, while using some other fastening means to secure the connector in place. Therefore, the invention contemplates having connectors 10 made from a common mold where the connectors can be adapted for use at one of a plurality of different mounting angles based on removal of one or more removable portions 22.

It will be appreciated that the removable portions 22 need not be of any particular shape or size, so long as they may receive a fastener or projection from the mating assembly that will assist in securing the connector 10 to the mating assembly 30 or in determining the mounting angle of the connector relative to the assembly. Similarly, removal of a removable portion 22 could be made to form a notch or a void, such as a hole or slot, of any suitable shape.

Hence, with this invention, only one connector mold or die is needed to form common connectors which can then be adapted for use in different mounting angle positions depending on the removal of one or more specific removable portions. This prevents the need for additional tooling and corresponding lines of equipment to manufacture and handle a variety of different single-purpose connectors, while adding a minor processing step of removing the correct one or more removable portions. Use of the removable portions eliminates concern for installation error, because the common connector can be adapted to permit only one angular mounting position. Moreover, if desired, a reduction of parts can be achieved by using a single fastener to both orient the connector to the correct mounting angle and to secure the connector to the mating assembly. As an added benefit, removal of the respective one or more removable portions may be incorporated with a component testing station, so that successfully tested components can be readily identified as those having a mounting position available.

The construction of the connector 10 provides numerous benefits. As seen in the exemplary embodiment, it provides a simple, cost effective, yet highly efficient single connector structure which can be adapted for use at one of a plurality of specific mounting angles. A connector employing a plurality of removable portions to attain one of several potential mounting angles facilitates greater flexibility in product design. One skilled in the art will appreciate that the present invention could be utilized in various alternative embodiments involving electrical devices that may be common in some respects but that require different mounting angles in different settings.

Although, for the purpose of explanation, use of the present invention has been depicted in a connector mated to a motor of an idle air control valve and which is mounted to a product assembly, it will be understood that the invention may be embodied in a variety of advantageous constructions of electrical connectors. Also, it should be understood that any of a variety of seals and fastening mechanisms, dimensions and suitable materials of construction may be used to satisfy the particular needs and requirements of the end user. It will be apparent from consideration of the specification and practice of the invention disclosed herein that other embodiments of the invention, as well as modifications and variations of the exemplary devices depicted may be made without departing from the scope or spirit of the invention.

What is claimed is:

1. An electrical connector comprising:

a housing, a plurality of conductive terminals supported within the housing, and a connector mounting flange extending outward from the housing, the flange having a plurality of selectively removable portions to permit the connector upon removal of at least one of the portions to be adapted for use in a particular angular mounting position.

2. An electrical connector in accordance with claim 1, wherein the conductive terminals are over-molded into the housing.

3. An electrical connector in accordance with claim 1, wherein the housing further comprises terminal cavities for receipt of the conductive terminals.

4. An electrical connector in accordance with claim 1, wherein the flange and housing are monolithically molded of a dielectric material.

5. An electrical connector in accordance with claim 1, wherein the flange extends outward from less than the entire perimeter of the housing.

6. An electrical connector in accordance with claim 1, wherein the removable portions of the flange are defined by areas of reduced thickness of the flange.

7. An electronic connector comprising:

a housing and at least one conductive terminal supported within the housing, the housing having a connector mounting flange, the flange having a plurality of removable portions that correspond to a plurality of different angular connector mounting positions.

8. An electrical connector in accordance with claim 7, wherein removal of at least one of the removable portions of the flange permits the connector to be installed at a single connector mounting angle.

9. An electrical connector in accordance with claim 7, wherein the flange and housing are monolithically molded of a dielectric material.

10. An electrical connector in accordance with claim 7, wherein the removable portions of the flange are defined in part by apertures in the flange.

11. An electrical connector in accordance with claim 7, wherein the removable portions of the flange are defined by areas of the flange having a reduced thickness.

12. An electrical connector in accordance with claim 7, wherein removal of one of the removable portions of the flange creates a discontinuity in the flange which permits a fastener to engage the flange to mount the connector at a predetermined angle.

13. An electrical connector in accordance with claim 7, wherein the flange and removable portions further comprise notches having removable tabs.

14. An electrical connector in accordance with claim 13, wherein the thickness of the flange is greater than the thickness of the removable tabs.

15. An electronic connector comprising:

a housing having a connector mounting flange, the flange having a plurality of removable portions whereby at least one of the portions may be removed to form at least one void in the flange to adapt the connector for mounting at one particular angle of a plurality of mounting angles, the connector further comprising a plurality of electrically conductive terminals.

16. An electrical connector in accordance with claim 15, wherein the flange and housing are monolithically molded of a dielectric material.

17. An electrical connector in accordance with claim 15, wherein the electrical connector is a right angle connector.

18. An electrical connector in accordance with claim 15, wherein a first end of the terminals is located at a first housing end and extends in a first direction and a second end of the terminals is located at a second housing end and extends in a second direction which is perpendicular to the first direction.

19. An electrical connector in accordance with claim 15, wherein the flange extends peripherally outward from at least part of the housing.

20. An electrical connector in accordance with claim 15, wherein the connector further comprises a fastener for engagement with the flange through a void created by removal of a removable portion.

* * * * *